United States Patent [19]

Aldridge et al.

[11] Patent Number: 4,750,985

[45] **Date of Patent: * Jun. 14, 1988**

[54] COMBINATION COKING AND HYDROCONVERSION PROCESS

[75] Inventors: Clyde L. Aldridge; Roby Bearden, Jr., both of Baton Rouge, La.; Clarence M. Eidt, Jr., Far Hills, N.J.

[73] Assignee: Exxon Research and Engineering Company, Florham Park, N.J.

[ * ] Notice: The portion of the term of this patent subsequent to Feb. 11, 2003 has been disclaimed.

[21] Appl. No.: 805,720

[22] Filed: Dec. 6, 1985

Related U.S. Application Data

[63] Continuation-in-part of Ser. No. 676,863, Nov. 30, 1984, Pat. No. 4,569,751, which is a continuation-in-part of Ser. No. 561,469, Dec. 14, 1983, abandoned.

[51] Int. Cl.[4] ..... C10G 69/06; C10G 69/10; C10G 69/00

[52] U.S. Cl. ..... 208/53; 208/50; 208/131; 208/108; 208/112; 208/39; 208/211; 208/251 H; 208/254 H; 208/68; 208/54

[58] Field of Search ..... 208/54, 53, 50, 55, 208/131, 111, 68, 39, 44, 211, 254 H, 251 H, 112

[56] References Cited

U.S. PATENT DOCUMENTS

| | | | |
|---|---|---|---|
| 2,614,067 | 10/1952 | Reed et al. | 196/49 |
| 2,888,393 | 5/1959 | Ballard et al. | 208/58 |
| 3,245,900 | 4/1966 | Paterson | 208/56 |
| 3,684,689 | 8/1972 | Patton et al. | 208/54 |
| 4,163,707 | 8/1979 | Goudriaan et al. | 208/44 |
| 4,169,038 | 9/1979 | Metrailer et al. | 208/10 |
| 4,178,227 | 12/1979 | Metrailer et al. | 208/50 |
| 4,204,943 | 5/1980 | Metrailer et al. | 208/50 |
| 4,569,751 | 2/1986 | Eidt, Jr. et al. | 208/50 |
| 4,569,752 | 2/1986 | Aldridge et al. | 208/55 |
| 4,579,646 | 4/1986 | Grosboll et al. | 208/53 |

OTHER PUBLICATIONS

Strong, Kingzett's Chemical Encyclopedia, Bailliere, Tindall and Cox, 8th Ed., 1952, pp. 83–84.

Bridge et al., "Residua Processes Proven", Technology, Oil & Gas Journal, Jan. 19, 1981, pp. 85–96.

*Primary Examiner*—Helen M. S. Sneed

*Assistant Examiner*—Chung K. Pak

*Attorney, Agent, or Firm*—Henry E. Naylor

[57] ABSTRACT

A carbonaceous feed, such as a heavy hydrocarbonaceous oil or coal and mixtures thereof, is upgraded by a combination coking and catalytic slurry hydroconversion process which may be integrated with a deasphalting process.

8 Claims, 1 Drawing Sheet

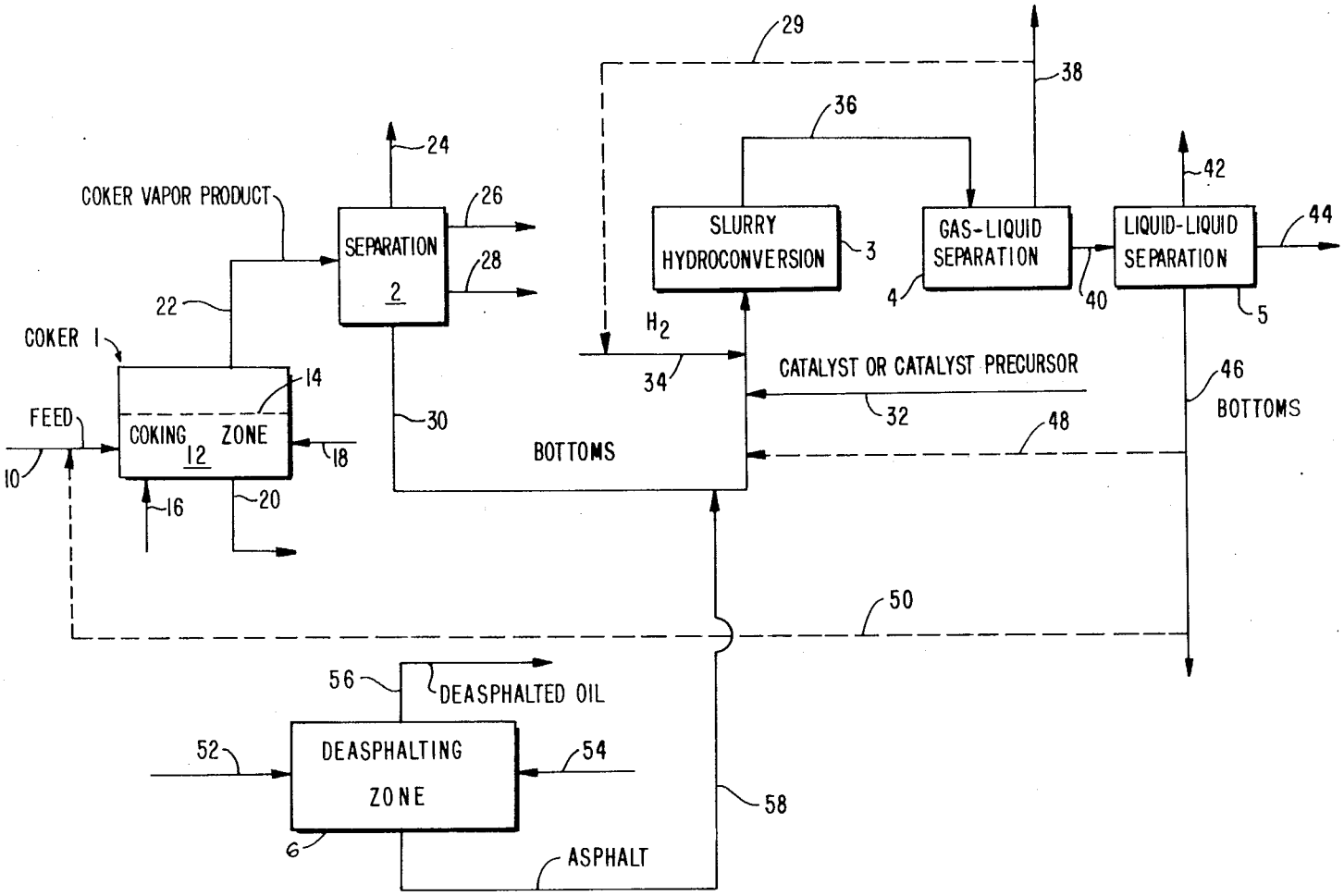
LIQUID-LIQUID SEPARATION
GAS-LIQUID SEPARATION
SLURRY HYDROCONVERSION
SEPARATION 2
COKING ZONE 12
DEASPHALTING ZONE
CATALYST OR CATALYST PRECURSOR
BOTTOMS
BOTTOMS
DEASPHALTED OIL
ASPHALT
COKER VAPOR PRODUCT
COKER 1
FEED
$H_2$
5
4
3
6
2
1
10
12
14
16
18
20
22
24
26
28
29
30
32
34
36
38
40
42
44
46
48
50
52
54
56
58

COMBINATION COKING AND HYDROCONVERSION PROCESS

CROSS REFERENCE TO RELATED APPLICATIONS

This application is a continuation-in-part application of U.S. patent application Ser. No. 676,863 filed Nov. 30, 1984, now U.S. Pat. No. 4,569,751, which is a continuation-in-part of U.S. patent application Ser. No. 561,469, filed Dec. 14, 1983, abandoned, the teachings of which are hereby incorporated by reference.

BACKGROUND OF THE INVENTION

1. Field of the Invention

The present invention relates to an integrated coking and hydroconversion process for upgrading carbonaceous materials.

2. Description of the Prior Art

Coking is a well-known process. The fluid coking process is described, for example, in U.S. Pat. No. 2,881,130, the teachings of which are hereby incorporated by reference. The fluid coking process can be conducted with or without recycle of the heavy normally liquid constituents of the coker product are not recycledto the coking zone, the process is referred to as "once-through" coking. Integrated fluid coking and coke gasification processes are also known and disclosed, for example, in U.S. Pat. Nos. 3,702,516; 3,759,676, and 4,325,815, the teachings of which are hereby incorporated by reference. Delayed coking is a well-known process in which a hydrocarbonaceous oil is heated to a cracking temperature and then passed into a coking drum to produce a vapor phase product, including hydrocarbons and coke. The drum is decoked by hydraulic or by mechanical means. See *Hydrocarbon Processing*, September 1980, page 153.

U.S. Pat. No. 4,134,825 discloses a catalytic slurry hydroconversion process conducted at a pressure of 500 to 5000 psig and at elevated temperatures. The catalyst is produced in the oil feed from a catalyst precursor.

The term "hydroconversion" is used herein to designate a process conducted in the presence of hydrogen in which at least a portion of the heavy constituents of a hydrocarbonaceous oil is converted to lower boiling products while it may simultaneously reduce the concentration of nitrogenous compounds, sulphur compounds and metallic contaminants.

U.S. Pat. No. 3,684,689 discloses fluid coking a residuum at a pressure above 150 psig. The coker bottoms are passed to a hydrocracking zone. The stream passed to the hydrocracking zone is a gas oil (see column 3, line 74 and column 6, lines 72–73).

U.S. Pat. No. 2,614,067 discloses coking a topped crude oil in a fluid coker. A gas oil fraction from a fractionator is used as absorber oil in an absorber. The absorber bottoms are passed to a slurry hydrogenation reactor. The absorber bottoms do not seem to include constituents boiling above 1050° F.

U.S. Pat. No. 3,245,900 discloses coking a residuum and sending the coker distillate to a hydrocracking zone.

U.S. Pat. No. 2,888,393 discloses fluid coking at a pressure of 200 to 2000 psig and hydrogenating the entire coker effluent at a pressure ranging from 200 to 2000 psig.

U.S. Pat. Nos. 4,204,943; 4,178,227, and 4,169,038 disclose combination hydroconversion and coking in which the bottoms portion of the hydroconverted product is used as feed to the coking zone.

It has now been found that an integrated coking and hydroconversion process in which the coker bottoms, including materials boiling above 1050° F., are combined with the asphalt fraction of a deasphalting process and subsequently converted in a catalytic slurry hydroconversion stage, will provide advantages that will become apparent in the ensuing description.

All boiling points referred to herein are atmospheric pressure equivalent boiling points unless otherwise specified.

SUMMARY OF THE INVENTION

In accordance with the invention, there is provided an integrated coking and hydroconversion process which comprises the steps of:

(a) treating a carbonaceous feed having a Conradson carbon content of at least 5 weight percent in a coking zone at coking conditions to produce coke and a vapor phase product, including hydrocarbons boiling above about 1050° F.;

(b) separating a heavy bottoms fraction, including said hydrocarbons boiling above 1050° F. from said vapor phase product;

(c) adding asphalt, and a hydroconversion catalyst or a hydroconversion catalyst precursor to at least a portion of said heavy bottoms fraction to form a mixture; and (d) subjecting at least a portion of said mixture of step (c) to hydroconversion conditions, in the presence of hydrogen, in a slurry hydroconversion zone to produce a hydroconverted oil.

BRIEF DESCRIPTION OF THE DRAWING

The FIGURE is a schematic flow plan of one embodiment of the invention.

DESCRIPTION OF THE PREFERRED EMBODIMENT

The integrated process of the present invention comprises coking and slurry hydroconversion of the coker bottoms. Preferably, the process is an integrated coking, slurry hydroconversion, and deasphalting process. The coking process may be fluid coking or delayed coking. Preferably, the coking process is fluid coking. Delayed coking conditions are well known and include a temperature ranging from about 775° F. to about 1000° F. and a pressure ranging from about 10 to about 200 psig. The preferred embodiment will be described with reference to the accompanying FIGURE.

Referring to the FIGURE, a carbonaceous material is passed by line 10 into coking zone 12 in coker 1 in which is maintained a fluidized bed of solids, e.g., coke particles of 40 to 1000 microns in size shown as having an upper level 14.

Carbonaceous Feeds

Suitable feeds for introduction into coking zone 12 include heavy hydrocarbonaceous oils; heavy and reduced petroleum crude oil; petroleum atmospheric distillation bottoms; petroleum vacuum distillation bottoms; pitch; asphalt; bitumen; other heavy hydrocarbon residues; tar sand oil; shale oil; coal; coal slurries; liquid products derived from coal liquefaction processes, including coal liquefaction bottoms, and mixtures thereof. Typically, such feeds have a Conradson carbon content of at least 5 weight percent, generally from about 5 to about 50 weight percent, preferably above 7 weight percent (as to Conradson carbon residue, see ASTM Test D189-65). Preferably the feed is a hydrocarbonaceous oil comprising at least 10 weight percent of materials boiling above 1050° F. A fluidizing gas, e.g., steam, is admitted at the base of coker 1 through line 16 in an amount sufficient to obtain a superficial fluidizing gas velocity in the range of 0.5 to 5 feet per second. The fluidizing gas may comprise steam, vaporized normally liquid hydrocarbons, normally gaseous hydrocarbons, hydrogen, hydrogen sulfide and mixtures thereof. Typically, the fluidizing gas will comprise steam. Solids at a temperature above the coking temperature, for example, 100 to 1000 Fahrenheit degrees above the actual operating temperature of the coking zone are admitted to coker 1 by line 18 in an amount sufficient to maintain the coking temperature in the range of about 850° to about 1400° F., preferably from about 900° to about 1200° F. The pressure in the coking zone is maintained suitably in the range of about zero to about 100 pounds per square inch gauge, (psig), preferably in the range of about 5to about 45 psig. The lower portion of the coker serves as a stripping zone to remove occluded hydrocarbons from the solids. A stream of stripped solids is withdrawn from coker 1 by line 20 for passage to a gasifier (not shown) or to a heater (not shown) to heat the solids. The heater may be operated as a conventional coker burner as disclosed in U.S. Pat. No. 2,881,130, the teachings of which are hereby incorporated by reference. Alternatively, the heater may be operated as a heat exchange zone such as disclosed in U.S. Pat. Nos. 3,661,543; 3,702,516, and 3,759,676, the teachings of which are hereby incorporated by reference. The heated solids are recycled to coker 1 by line 16 to supply heat for the endothermic coking reaction. The vaporous coker product, which comprises light hydrocarbons and heavy hydrocarbons, including materials boiling above 1050° F., is passed by line 22 to a separation zone 2 which may be a scrubbing zone or a fractionation zone. In separation zone 2, the coker vapor phase product is separated into a gas removed by line 24, a light boiling hydrocarbonaceous stream removed by line 26, and an intermediate boiling fraction removed by line 28. A heavy bottoms fraction, including hydrocarbons boiling above 1050° F., is removed by line 30. The heavy bottoms fraction removed by line 30 has a Conradson carbon content of at least 5 weight percent, preferably at least 7 weight percent and generally comprises at least about 10 weight percent hydrocarbons boiling above 1050° F. Further, the heavy bottoms fraction contains hydrocarbons having boiling points from about 650° to about 1050° F. Preferably, the initial boiling point is at least about 975° F. Asphalt derived from a deasphalting process is introduced by line 58 into the bottoms fraction carried in line 30. The asphalt may suitably be added to the bottoms of line 30 in an amount sufficient to provide from about 10 to about 90 weight percent, preferably from about 40 to about 85 weight percent asphalt, based on the total weight of the resulting mixture. The asphalt is a fraction obtained by deasphalting an asphaltene-containing oil derived from any source. Preferably, the deasphalting process is integrated with the coking and hydroconversion steps as shown in the FIGURE in which an asphaltene-containing hydrocarbonaceous oil such as a vacuum residuum, an atmospheric residuum or any of the known asphaltene-containing feeds conventionally used in deasphalting processes, is introduced in deasphalting zone 6 to contact a deasphalting solvent introduced into deasphalting zone 6 by line 54.

Suitable deasphalting solvents include $C_3$ to $C_{16}$ aliphatic hydrocarbons, preferably $C_3$ to $C_{10}$ aliphatic hydrocarbons, more preferably $C_4$ to $C_{10}$ aliphatic hydrocarbons and mixtures thereof. Deasphalting methods utilizing solvents that extract or precipitate asphaltenes are well known and are described, for example, in Kalichevsky, *Petroleum Refining with Chemicals*, Elsevier Publishing Co. 1956, pages 388–396. Suitable volumetric ratios of solvent to asphaltene-containing oil will generaly range from about 0.5:1 to 10:1, preferably 1:1 to 4:1. The solvent contacting step is conducted at conditions and for a time sufficient to extract or precipitate the asphaltenes from the asphaltene-containing oil. For example, suitable conditions for deasphalting with pentane as deasphalting solvent include a temperature ranging from about 170° to about 400° F., a pressure ranging from about 50 to 500 psig and a time period ranging from 5 minutes to 2 hours.

The deasphalted oil is removed by line 56. The asphalt resulting from the deasphalting process is removed by line 58. This asphalt is suitable for use in the process of the present invention for introduction in a suitable amount into the bottoms fraction carried in line 30. A catalyst or catalyst precursor is added by line 32 to the bottoms fraction carried in line 30. The order of addition of the catalyst or catalyst precursor is not critical. The catalyst or catalyst precursor could be introduced into line 30 before the addition of the asphalt, simultaneously with the addition of the asphalt or after the addition of the asphalt. Alternatively, the catalyst or catalyst precursor may be introduced directly into slurry hydroconversion zone 3. If desired, a portion of the feed of line 10, for example up to about 25 weight percent, and/or a portion of the oil of line 52, for example, up to about 25 weight percent may be diverted and introduced directly into the bottoms fraction carried in line 30. A hydrogen-containing gas is introduced by line 34 into line 30 or directly into hydroconversion zone 3.

The Hydroconversion Catalyst

The hydroconversion catalyst introduced into heavy bottoms fraction 30 to form a slurry may be any suitable hydroconversion catalyst or catalyst precursor suitable for use in slurry processes. The catalyst may comprise a group IVB, VB, VIB, VIIB or VIII metal, metal oxide or metal sulfide or mixtures thereof of the Periodic Table of Elements and may be supported or unsupported catalysts. The Periodic Table of Elements referred to herein is in accordance with the table of E. H. Sargent and Company, copyright 1962, Dyna Slide Company. Instead of a preformed catalyst, a catalyst precursor may be used such as an oil soluble or oil dispersible or a thermally decomposable metal compound such as, for example, the catalyst precursor described in U.S. Pat. No. 4,226,742, the teachings of which are hereby incorporated by reference. Catalysts comprising cobalt, molybdenum, nickel, tungsten, iron and mixtures thereof on an alumina-containing support or on a carbonaceous support such as coal or coke are also suitable. Suitable catalysts or catalyst precursors include tarsands; solid carbonaceous materials such as coal, petroleum coke, coal coke (char), soot; and the ashes of any of these materials produced by combustion and/or gasification and mixtures of any of these materials; carbonaceous solids having an average particle size of less than 10 microns in diameter or the ashes thereof such as the catalyst described in U.S. Pat. No. 4,204,943; U.S. Pat. No. 4,169,038; and U.S. Pat. No. 4,178,227, the teachings of which are hereby incorporated by reference. The term "coal" is used herein to include all ranks of coal such as anthracite coal, bituminous coal, semibituminous coal, sunbbituminous coal, lignite, and peat. The catalyst or catalyst precursor is added to the coker bottoms carried in line 30 by line 32. Alternatively, the catalyst or catalyst precursor may be introduced directly into slurry hydroconversion zone 3. The amount of catalyst or catalyst precursor added to the heavy coker bottoms will vary widely depending on the type of catalyst or catalyst precursor used.

Slurry Hydroconversion Operating Conditions

Suitable conditions in the slurry hydroconversion zone are summarized in Table I.

TABLE I

| Conditions | Broad Range | Preferred Range | More Preferred Range |
|---|---|---|---|
| Temp., °F. | 650 to 1000 | 800 to 900 | 820 to 880 |
| Hydrogen Partial Pressure, psig | 100 to 8000 | 1000 to 6000 | 2000 to 5000 |

In the slurry hydroconversion zone, at least 10 weight percent, preferably at least 50 weight percent, more preferably at least 75 weight percent of the materials boiling above 1050° F. that are present in the heavy bottoms fraction subjected to slurry hydroconversion conditions is converted to lower boiling products.

The hydroconversion zone effluent is removed by line 36 and passed into a gas-liquid separation zone 4 wherein the normally gaseous phase is separated from a normally liquid phase. The gaseous phase is removed from separation zone 4 by line 38. Alternatively, the gaseous phase, which comprises hydrogen, may be recycled by line 29, preferably after removal of undesired constituents, to the slurry hydroconversion zone via line 34. The normally liquid phase, which comprises the hydroconverted hydrocarbonaceous oil having a decreased Conradson carbon content, is passed by line 40 to separation zone 5 for fractionation by conventional means, such as distillation, into various fractions such as light, medium boiling and heavy bottoms fractions. The light fraction is removed by line 42. The medium boiling fraction is removed by line 44. The heavy bottoms fraction is removed by line 46 and, if desired, at least a portion of the bottoms fraction may be recycled to hydroconversion zone 3 by line 48 and/or to coking zone 12 by line 50.

The following examples are provided to illustrate the invention.

EXAMPLE 1

(Run 1274)

To a 300 cc Autoclave Engineers magnetically stirred autoclave was charged 40.0 g. of once through coker bottoms derived from coking Heavy Arabian vacuum residuum, 40.0 g. of asphaltfrom a deasphalting unit and 4.00 g. of ash derived from Illinois #6 coal. The once through coker bottoms was 100% 975+°F. material and contained 24.3% Conradson carbon. The asphalt was 78.5% 975+°F. maerial and contained 28.7% Conradson Carbon.

The autoclave was flushed with hydrogen, vented, and pressured with 100 psia of $H_2S$ and then to 2850 psig with $H_2$. The autoclave was heated with stirring to 438.5° C. in 52 minutes, held between 438.5° and 443° C. for 1 hr., cooled quickly to room temperature and vented through a 10% aqueous sodium hydroxide scrubber and the gases measured and collected. The autoclave was pressured again with 100 psia $H_2S$ and then to 2600 psig with $H_2$, heated with stirring to 438.5° C. in 50 minutes and held between 438.5° C. and 443° C. for 2 hrs. after which the autoclave was cooled quickly and vented through a 10% aqueous sodium hydroxide scrubber and the gases measured and collected. The average $H_2$ partial pressure during the two reaction periods was 4137 psig.

The autoclave was washed with 360 g. of toluene and the contents filtered. The recovered dried solids weighed 4.33 g. The toluene solution was distilled to recover the unconverted 975+°F. bottoms which amounted to 8.0 g. The gases were analyzed by mass spectroscopy. The net coke make was 0.41 wt. % on oil feed, the $C_1$–$C_3$ gas yield 7.83% on oil feed, and the 975+°F. oil conversion to 975−°F. oil plus gas was 88.3%.

EXAMPLE 2

(Run 1269)

An experiment was carried out according to the procedure of Example 1 except that 4.00 g. of 100 mesh Illinois coal containing 12.11% ash was used instead of the coal ash. The non-ash portion of the coal was counted for calculation purposes as 975+°F. oil. The average $H_2$ partial pressure during the two reaction periods was 4432 psig. The coke yield was 2.3 wt.% on total feed, the $C_1$–$C_3$ gas yield was 10.6%, and the 975+°F. conversion to 975°−F. oil plus gas was 81.5%.

EXAMPLE 3

(Run 1144)

To a 300 cc Autoclave Engineers magnetically stirred autoclave was charged 90.0 g. of asphalt from a deasphalting unit and 30.0 g. or 975+°F. coker bottoms together with 1.00 g. of 20% molybdenum naphthenate (6% Mo) in toluene (100 ppm Mo on total feed). The analyses of these feedstocks were the same as given in Example 1. The autoclave was flushed with $H_2$ and pressure tested, vented, and pressured to 50 psia $H_2S$ and then to 1400 psig with $H_2$. The autoclave was heated with stirring to 380° C. in 44 minutes and held at 380°–385° C. for 20 minutes after which a flow of 0.36 liter per minute of $H_2$ was introduced while maintaining 2100 psig back pressure. The gas was passed through a 10% aqueous sodium hydroxide scrubber, measured by a wet test meter, collected and analyzed by mass spectroscopy. After the temperature was held at 380°–385° C. for the twenty minutes, it was raised to 438° C. over the course of 18 minutes then held at 438°–443° C. for 3 hours while maintaining the gas flow, after which the flow was stopped and the autoclave rapidly cooled and vented. The autoclave was washed with 360 g. toluene and the liquid filtered to yield 2.09 g. of dry solid. The liquid product was distilled to yield 22.2 g. of 975+°F. bottoms. The coke yield was 1.74 wt.% on feed, the $C_1$–$C_3$ gas yield 6.88 wt.% and the 975+°F. conversion to 975−°F. oil plus gas was 76%.

EXAMPLE 4

(Run 1148)

An experiment was carried out similar to Example 3 except that a solution of 20% phosphomolybdic acid in phenol dispersed in Heavy Arabian atmospheric residuum to yield a concentrate containing 6000 wppm Mo was used instead of molybdenum naphthenate in toluene. Two (2.00) grams of this catalyst precursor concentrate was used to provide 100 wppm Mo on feed. The coke yield was 2.24 wt.% on feed, the $C_1$–$C_3$ gas yield 6.91 wt.%, and the conversion of 975+°F. material to 975−°F. oil plus gas was 78%.

What is claimed is:

1. An integrated coking and hydroconversion process which comprises the steps of:

(a) treating a carbonaceous feed having a Conradson carbon content of at least 5 weight percent in a delayed coking or fluidized coking zone at coking conditions to produce coke and a vapor phase product having hydrocarbons boiling about 1050° F., (b) separating a heavy bottoms fraction having said hydrocarbons boiling above 1050° F. from said vapor phase product;

(c) adding asphalt, and an oil soluble metal compound hydrocarbon catalyst precursor or a thermally decomposable metal compound catalyst precursor to at least a portion of said heavy bottoms fraction to form a mixture comprised of from about 40 to 85 weight percent asphalt; and (d) subjecting said mixture of step (c) to hydroconversion conditions within the temperature range of about 650° to about 1000° F. and a hydrogen partial pressure of about 100 to 8,000 psig, in the presence of hydrogen, in a slurry hydroconversion zone to convert said mixture or portion of said mixture to lower boiling products.

2. The process of claim 1 wherein said heavy bottoms fraction resulting from step (b) further contains hydrocarbons having boiling points from about 650° to about 1050° F.

3. The process of claim 1 wherein said coking conditions include a temperature ranging from about 775° F. to about 1400° F.

4. The process of claim 1 wherein said carbonaceous feed has a Conradson carbon content of at least about 7 weight percent.

5. The process of claim 1 wherein said heavy bottoms fraction of step (b) comprises at least about 10 weight percent of said hydrocarbons boiling above 1050° F.

6. The process of claim 1 wherein said delayed coking zone is operated at a temperature ranging from about 775° to 1000° F.

7. The process of claim 1 wherein said fluid coking zone is operated at a temperature ranging from about 850° to 1400° F.

8. The process of claim 1 wherein said asphalt of step (c) is derived from a deasphalting step which treats an asphaltene containing oil with a solvent at deasphalting conditions to produce deasphalted oil and said asphalt.

* * * * *